US006598776B2

(12) United States Patent
Adachi et al.

(10) Patent No.: US 6,598,776 B2
(45) Date of Patent: Jul. 29, 2003

(54) STAPLE GUN

(75) Inventors: Michiaki Adachi, Tokyo (JP); Makoto Kosuge, Tokyo (JP); Tomofumi Ichiba, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 09/951,203

(22) Filed: Sep. 13, 2001

(65) Prior Publication Data

US 2002/0030079 A1 Mar. 14, 2002

(30) Foreign Application Priority Data

Sep. 14, 2000 (JP) ..... 2000-280002

(51) Int. Cl.[7] ..... B27F 7/13
(52) U.S. Cl. ..... 227/123; 227/127; 227/128
(58) Field of Search ..... 227/123, 127, 227/128

(56) References Cited

FOREIGN PATENT DOCUMENTS

TW 363492 7/1999 ..... B25C/1/04

*Primary Examiner*—Scott A. Smith
*Assistant Examiner*—Nathaniel Chukwurah
(74) *Attorney, Agent, or Firm*—Chapman and Cutler

(57) ABSTRACT

A staple gun comprising a main body and a staple injection nozzle for injecting a staple into a target object, the staple injection nozzle including a nozzle body mounted on a staple striking body and a cover plate for removably closing an upper portion of a staple injection path of the nozzle body so as to guide the staple. The nozzle body has protrusions to receive an end portion of the cover plate and press this cover plate from upward, and an urging member is provided to urge the cover plate in a direction that the end portion of the cover plate intrudes into the protrusions.

3 Claims, 5 Drawing Sheets

STAPLE GUN

BACKGROUND OF THE INVENTION

1. Field of the Invention

The present invention relates to a staple gun and in particular to a staple gun.

2. Description of the Prior Art

Conventionally, there are known staple guns such as those using electric power or compressed air to inject a staple into a target object.

FIG. 8 shows a staple injection nozzle 1 for injecting a staple from a staple gun into a target object. This staple injection nozzle 1 has a nozzle body 2 protruding from the front portion of the staple gun. In this nozzle body 2, a staple injection path 3 is formed through which the stable is injected. The staple (not depicted) has a pair of pins to be struck into a target object and a linking portion connecting these pins. The pins are set in the staple injection path 3 in such a manner that the pins are directed toward the target object. The staple set in the staple injection path 3 is pushed forward from the rear end thereof by a staple driver.

The staple injection path 3 has an upper portion closed by a cover plate 4 that can be opened, enabling to remove a staple which has been bent or a plurality of staples which are jammed.

In order to fix the cover plate 4, protrusions 5, 5 are provided at the top of two sides of the nozzle body 2. Bearings 9, 9 protrude from a rear portion of the surface of the cover plate 4 having a pin 8 for receiving a hinge portion 7 of a lock lever 6, so that both ends of a band 10 are rotatably held at both ends of the lock lever 6.

The cover plate 4 is supported on stepped portions 11, 11 formed on the side walls of the staple injection path 3. With the lock lever 6 rotated around the pin 8 to be in a raised state, the linkage portion 12 of the band 10 is set over the protrusions 5, 5. Then, the lock lever 6 is rotated around the pin 8 to be set in a lowered state and the band 10 is in an expanded state, so that the linkage portion 12 of the band is fixed to the stepped portions 11, 11.

However, such a staple gun has a problem that when a staple is injected from the staple injection nozzle 1, a staple may be subjected to a force caused by shock of the staple driver or hardness of a target object, the force tending to open, i.e., remove the cover plate 4 from the nozzle body 2. Moreover, when a staple is jammed in the staple injection path 3, the cover plate 4 is subjected to a force to open the cover plate 4 and a large load F is applied from the cover plate 4 directly to the linkage portion 12 of the band 10. This causes plastic deformation of the linkage portion 12, thereby lowering the force to push the cover plate 4. Thus, the cover plate 4 begins to rattle, changing a staple injection orbit, which in turn easily causes a staple jam.

SUMMARY OF THE INVENTION

It is therefore an object of the present invention to provide a staple gun capable of suppressing rattle of a cover plate.

DETAILED DESCRIPTION OF THE EMBODIMENTS

Description will now be directed to a staple gun according to an embodiment of the present invention with reference to the attached drawings.

Figure 7:
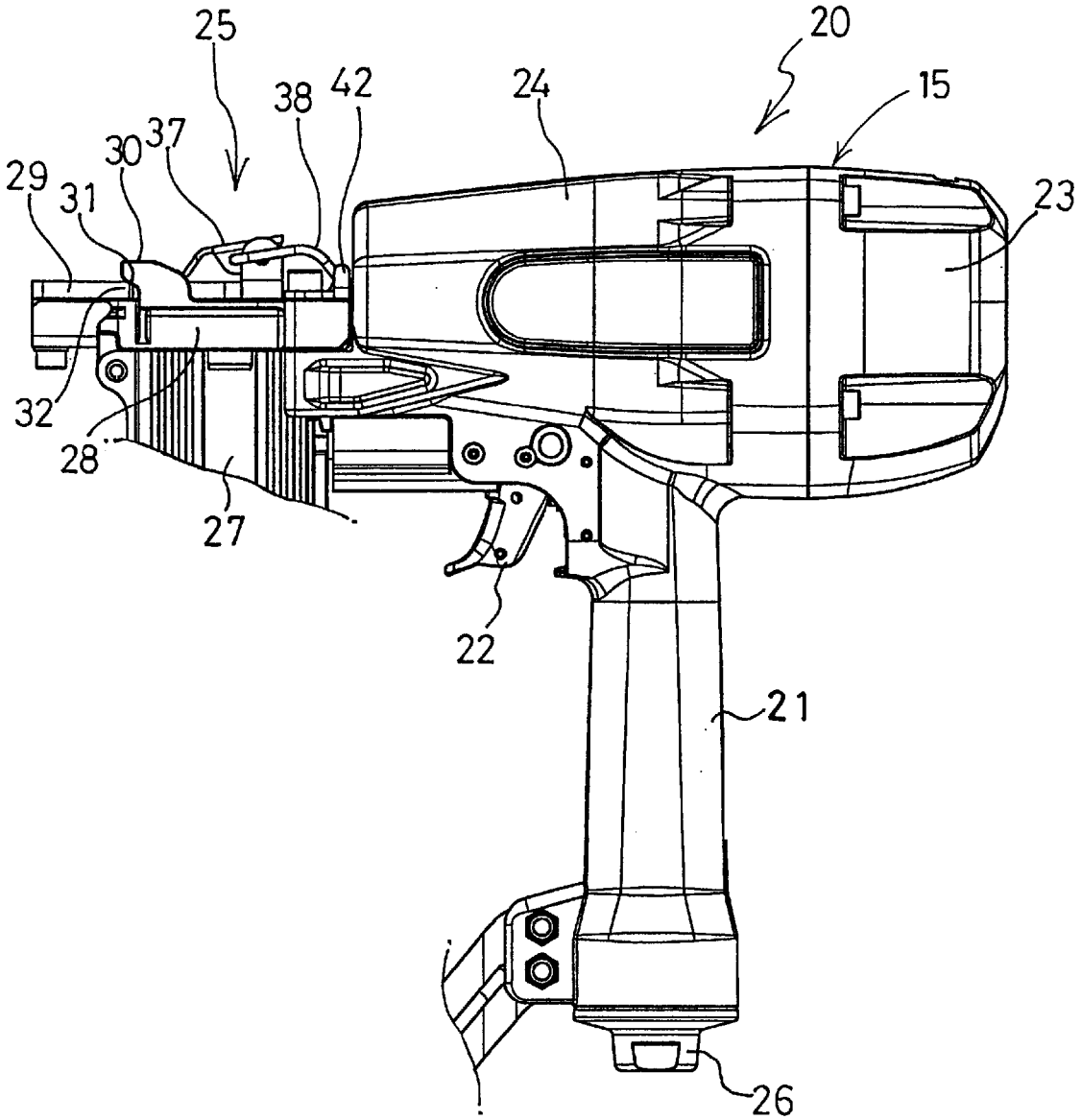
FIG. 7 shows an overall configuration of a staple gun having the staple injection nozzle of FIG. 1 to FIG. 7.
Figure 8:
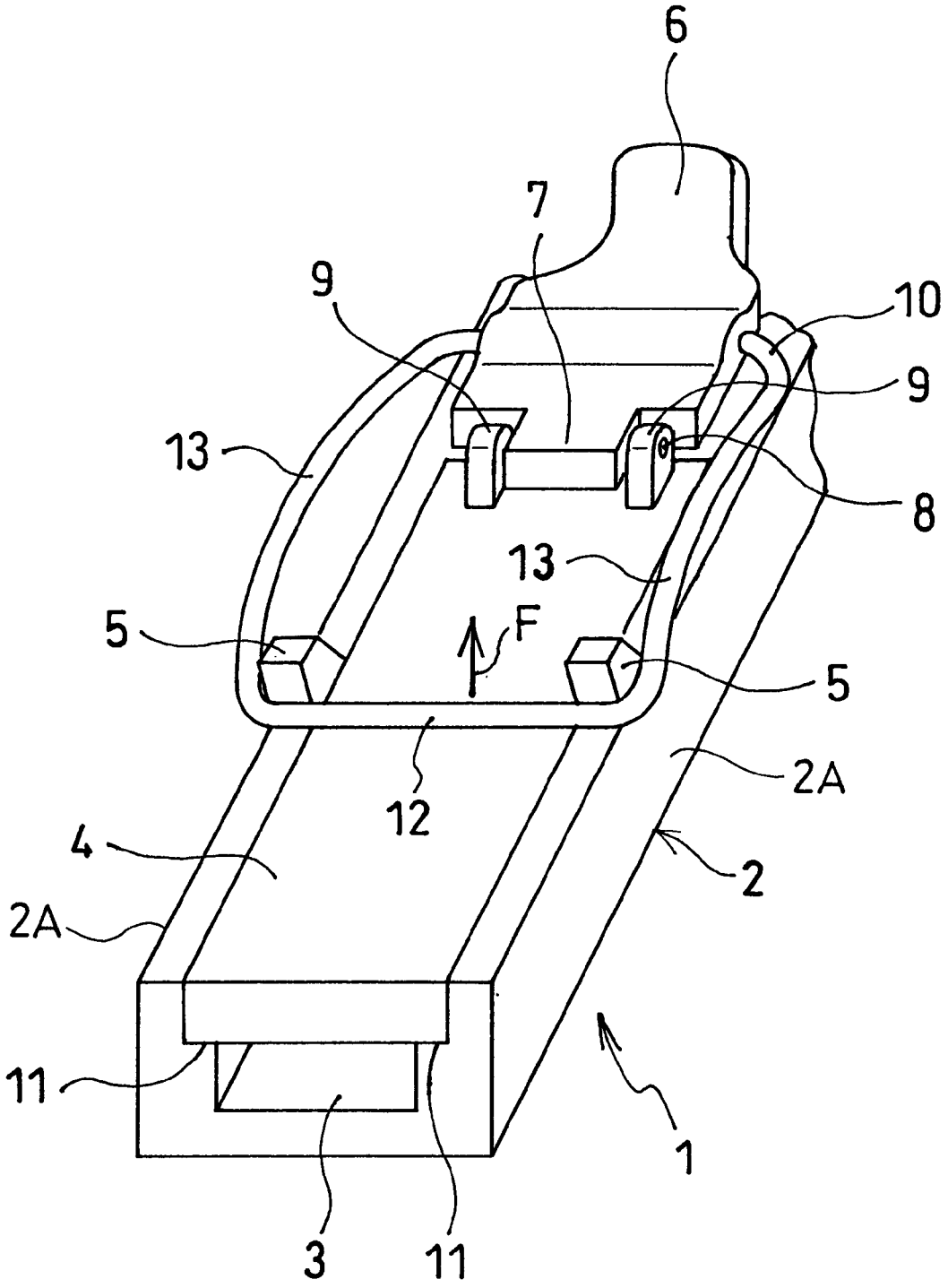
FIG. 8 is a partial enlarged view of a conventional staple injection nozzle.

FIG. 7 shows a staple gun 20. The staple gun 20 includes: a staple gun main body 15; a handle 21 arranged below the staple gun main body 15; a trigger 22 arranged at left of the handle 21; and a staple injection nozzle 25 protruding forward from the left end of the staple gun main body 15. The staple gun main body 15 has a cylinder block 24 and a cylinder head 23.

A coupler 26 is arranged below the handle 21 of the staple gun 20. The coupler 26 is connected to a coupler (not depicted) of a compressed air supply hose (not depicted). Compressed air supplied from the coupler 26 is introduced to the cylinder head 23 through the interior of the handle 21 when the trigger 22 is pulled. Thus, the compressed air is supplied to the cylinder block 24. The cylinder block 24 has a built-in piston (not depicted). A staple driver is fixed to this piston. The staple driver extends from the cylinder block 24 to the staple injection nozzle and moves reciprocally in a staple injection path 43 (FIG. 1, FIG. 4 to FIG. 6) in the staple injection nozzle 25 in accordance with the reciprocal movement of the piston. Inside the staple injection path 43, a staple inlet 43*a* (FIG. 4 to FIG. 6) is formed for supplying U-shaped staples one by one from the staple guide 27 (FIG. 7).

The staple injection nozzle 25 has a nozzle body 28 attached to the staple gun main body 15 and a cover plate 29 attached to the upper portion of the nozzle body 28. On the nozzle body 28, a staple injection path 43 is formed The cover plate 29 defines the upper portion of the staple injection path 43, so as to guide a staple to be injected, to a target object. At both sides of this cover plate 29, indentations 29A, 29A are formed. Bearings 35, 35 are arranged to protrude upward from both sides of rear portion of the cover plate 29.

At both sides of the nozzle body 28, protrusions 30, 30 are formed to be inserted into the indentations 29A, 29A of the cover plate 29, thereby fixing the cover plate 29. Each of the protrusions 30 is formed in a reversed L shape having a top portion 30*a* extending leftward in the figure. Below the top portions 30*a*, a taper surface 31 is formed in such a manner that the its height is gradually lowered toward the back (rightward in FIG. 3). The taper surface 31 is brought into abutment with a slanting surface (end portion) 33 of the left end 32 of the indentation 29A of the cover plate 29, so that the cover plate 29 is fixed to the nozzle body 28.

Figure 4:
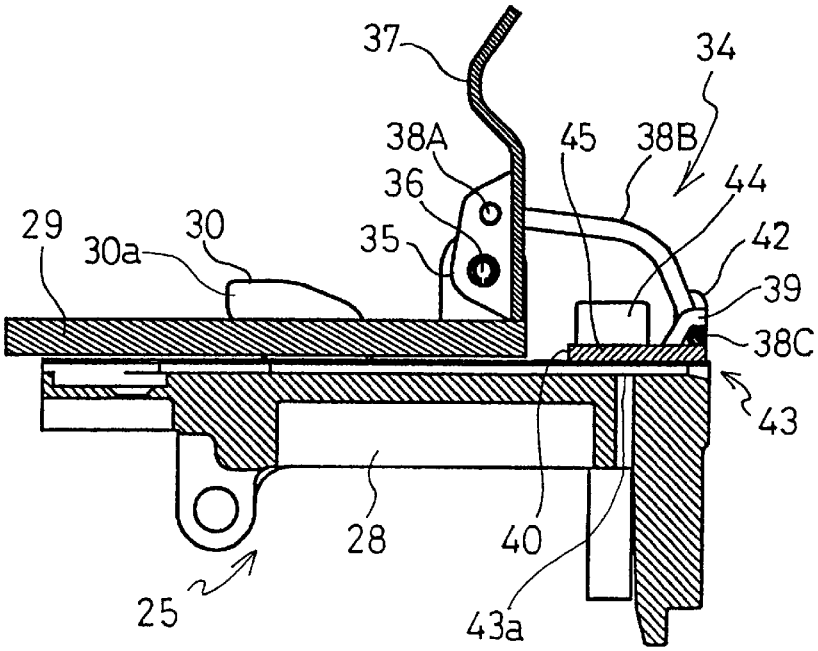
FIG. 4 is a cross sectional view showing the staple injection nozzle of FIG. 1 with a cover plate in an opened state.
Figure 5:
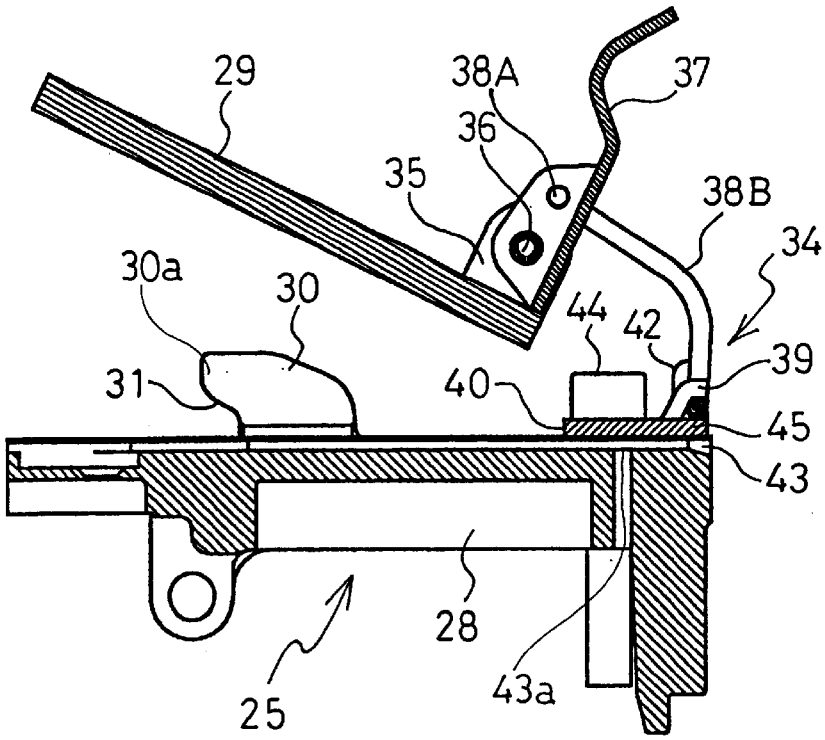
FIG. 5 is a cross sectional view showing the staple injection nozzle of FIG. 1 in a state prior to fixing the cover plate.
Figure 6:
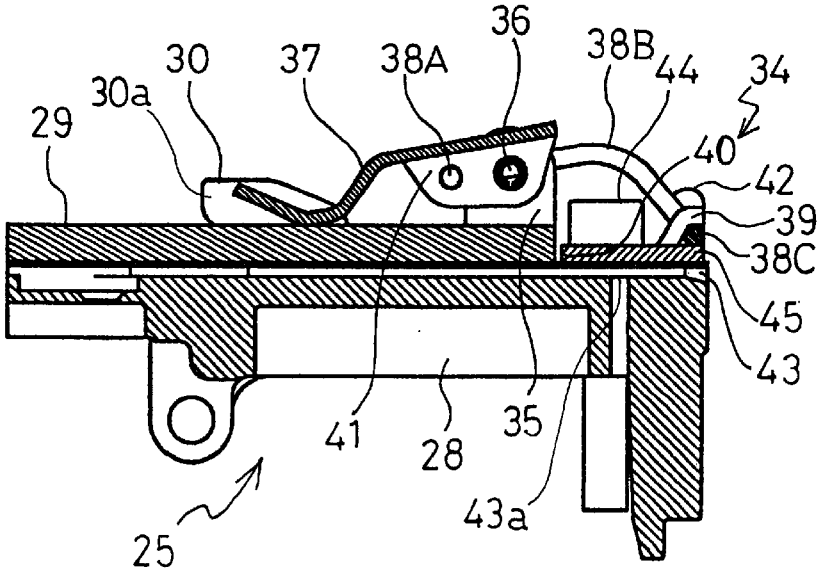
FIG. 6 is a cross sectional view of the cover plate of FIG. 6 set on the staple injection path and fixed to the staple injection path.

As shown in FIG. 4 to FIG. 6, at the back portion of the nozzle body 28, a plate member 45 is fixed by a bolt 44 so as to define the rear top portion of the staple injection path 43. This plate member 45 has hooks 39, 39 and stoppers 42, 42 at its both sides.

Moreover, the staple injection nozzle 25 has fixing means 34 for fixing the cover plate 29 to the nozzle body 28.

Figure 1:
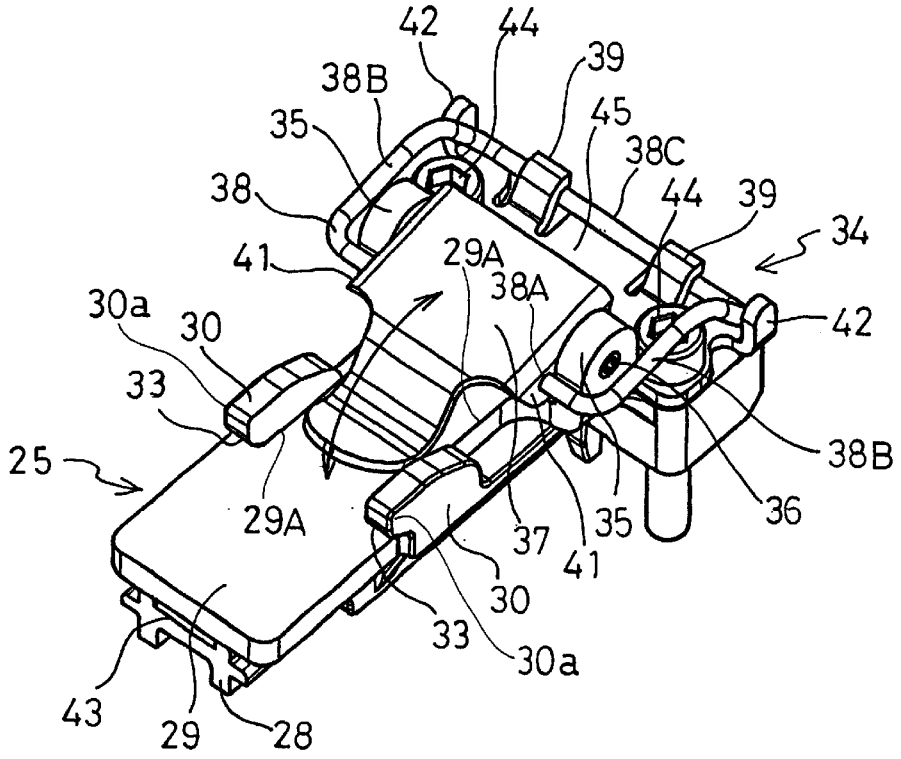
FIG. 1 is an enlarged view of a staple injection nozzle of a staple gun according to an embodiment of the present invention.
Figure 2:
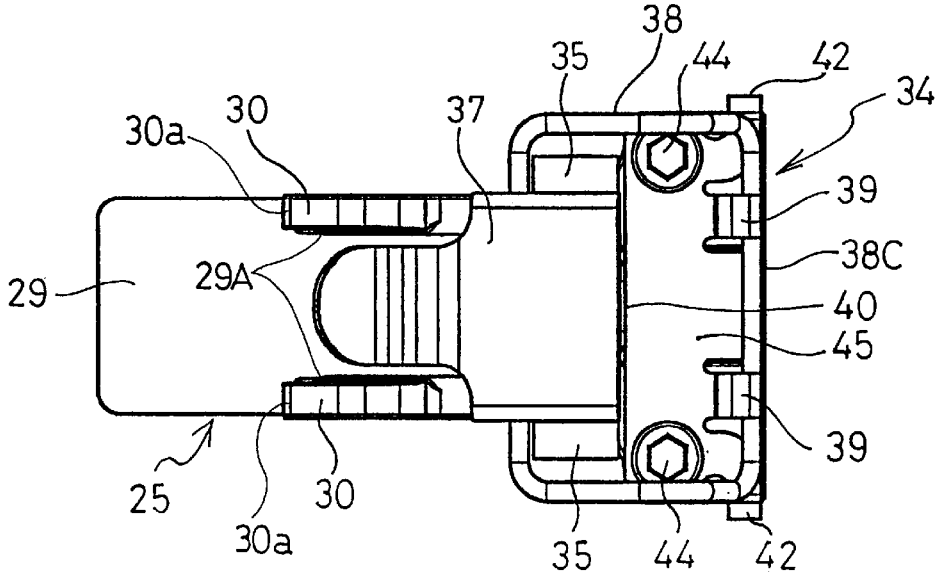
FIG. 2 is a plan view of the staple injection nozzle of FIG. 1.
Figure 3:
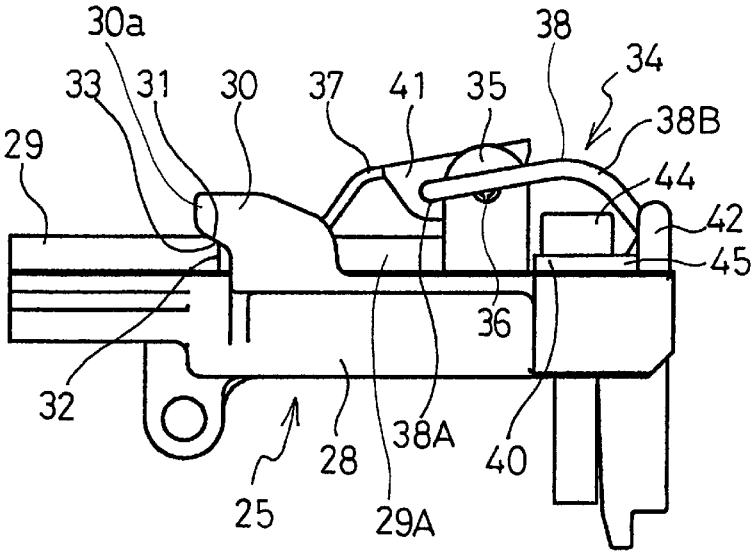
FIG. 3 is a side view showing engagement of main protrusions with cover protrusions in the staple injection nozzle of FIG. 1.

The fixing means 34 includes: a lock lever 37 whose rear portion is supported by a shaft 36 provided between the bearings 35, 35 of the cover plate 29; and a spring (urging member) for urging the lock lever 37 backward (rightward in FIG. 2 and FIG. 3). The spring 38 is constituted by a C-shaped needle when viewed in a plan view.

At both sides of the rear portion of the lock lever 37, bearing portions 41, 41 are provided to protrude downward. In the bearing portions 41, 41, a shaft 36 of bearings 35, 35 of the cover plate 29 is movably arranged. Moreover, both ends 38A, 38A of the spring 38 are rotatably held in the bearing portions 41, 41, i.e., at a position left (in FIG. 3 and FIG. 6) to the shaft 36 in such a manner that the lock lever 37 is rotated around the both ends 38A 38A.

As shown in FIG. 3 and FIG. 6, the spring 38 has intermittent portions 38, 38B curved to protrude upward so as to have an elastic force and a rear portion 38C, which is rotatably held on hook portions 39, 39 of the plate member 45. Moreover, the spring 38 is regulated by stoppers 42, 42 of the plate member 45 in its leftward/rightward movement (upward/downward in FIG. 2).

The hook portions 39, 39 have an open rear portion. When the cover plate 29 is opened in a normal condition, the hook portions 39, 39 rotatably hold the rear portion 38C of the spring 38. When the fixing means 34 is disassembled for repair, the rear portion 38C can be removed from the hook portions 39, 39.

When fixing this cover plate 29 onto the nozzle body 28, as shown in FIG. 5, the rear portion 38C of the spring 38 is held on the hook portions 39, 39 while the cover plate 29 is set on the staple injection path 43 as shown in FIG. 4. Here, the lock lever is in its raised state, the cover plate 29 is at a position forward from the position shown in FIG. 3, and the slanting surface 33 of the cover plate 29 is apart from the taper surface 31 of the protrusion 30 of the nozzle body 28.

As the lock lever 37 is tilted forward from this standing state, the lock lever is rotated counterclockwise (in FIG. 4) around the end portions 38A, 38A of the spring 38. This rotation of the lock lever 37 slides the cover plate 29 backward (rightward in FIG. 4). When the lock lever 37 is tilted as shown in FIG. 6, the slanting surface 33 of the cover plate 29 is brought into abutment with the taper surface 31 of the protrusion 30 of the nozzle body 28.

The cover plate 29 is urged backward by the urging force of the intermittent portion 38B of the spring 38, which in turn pushes the left end 32 of the indentation 29A of the cover plate 29 under the top portion 30*a* of the protrusion 30. That is, the cover plate 29 is pushed by the protrusion 30 from upward and firmly fixed to the nozzle body 28. This engagement is assured by a clearance in the order of 0.5 to 1 mm between the rear portion of the cover plate 29 and the front end 40 of the plate member 45.

When a staple is injected in a state with the cover plate 29 feed to the nozzle body 28, shock of the staple driver and a hardness of a target object or staple jam generates a force to push the cover plate 29 upward, i.e., to open the cover plate 29, the force is applied to the taper surface 31 of the top portion 30*a* of the protrusion 30. However, since the top portion 30*a* of the protrusion 30 protrudes forward, it is possible to prevent opening of the cover plate 29.

Thus, the force pushing the cover plate 29 upward is applied only to the taper surface 31 of the protrusion 30 and not to the spring 38. Accordingly, there is no danger of expansion of the intermittent portions 38B, 38B of the spring 38 and it is possible to keep urging the cover plate 29 backward. Accordingly, it is possible to assure a force to press down the cover plate 29 and firmly fix the cover plate 29 to the nozzle body 28. Thus, it is possible to surely prevent rattling of the cover plate 29 which would derange the staple injection orbit, easily causing a staple jam.

What is claimed is:

1. A staple gun having a main body and a staple injection nozzle for injecting a staple into a target object, the staple injection nozzle having a nozzle body mounted on a staple striking body and a cover plate for removably closing an upper portion of a staple injection path of the nozzle body so as to guide the staple, comprising:

protrusions provided on an intermediate position between opposite edge portions of said nozzle body;

projections of the cover plate, which are positioned in front of said protrusions and which are projected from opposite sides of said cover plate toward side directions;

means for urging the cover plate to cause a slanting surface of the cover plate to engage with the protrusions; and a lock lever supported via a shaft on the cover plate in such a manner that the lock lever can rotate upwardly and downwardly around the shaft, said means for urging having two end portions rotatably mounted at a position in front of the shaft on the lock lever and a rear portion rotatably held on a hook portion provided on a rear portion of the nozzle body for causing the cover plate to rotate about the hook portion, and an intermittent portion having an elastic force so as to urge the cover plate backward, projections on upper portions of the protrusions in the nozzle body, which forwardly project, said cover plate being fixed to the nozzle body by engaging rear edge portions of the projections of the cover plate with lower surfaces of the projections on the upper portions of the protrusions under a biased force of the means for urging when the cover plate is placed on the nozzle body, the upper portion of the staple injection path of the nozzle body is closed and the lock lever is downwardly rotated, the engagement of the rear edge portions of the projections of the cover plate and the projections on the upper portions of the protrusions in the nozzle body being disengaged when the lock lever is upwardly rotated, said cover plate being rotated about the rear portion of the means for urging together with rotation of the lock lever to open the cover plate.

2. The staple gun according to claim 1, wherein the lower surfaces of the projections on the upper portions of the protrusions in the nozzle body have slanting surfaces lowering gradually in accordance with proceeding rearwardly of the nozzle body.

3. The staple gun according to claim 1, wherein said projections of the cover plate have slanting surfaces lowering gradually in accordance with proceeding rearwardly of the cover plate.

* * * * *